US010611619B2

(12) United States Patent
Bolender

(10) Patent No.: US 10,611,619 B2
(45) Date of Patent: Apr. 7, 2020

(54) CONTAINER FOR RECEIVING BEVERAGES AND DEVICE FOR FILLING THE CONTAINER

(71) Applicant: Dirk Bolender, Menden (DE)

(72) Inventor: Dirk Bolender, Menden (DE)

( * ) Notice: Subject to any disclaimer, the term of this patent is extended or adjusted under 35 U.S.C. 154(b) by 45 days.

(21) Appl. No.: 16/061,906

(22) PCT Filed: Dec. 12, 2016

(86) PCT No.: PCT/DE2016/100572
§ 371 (c)(1),
(2) Date: Jun. 13, 2018

(87) PCT Pub. No.: WO2017/101904
PCT Pub. Date: Jun. 22, 2017

(65) Prior Publication Data

US 2018/0370784 A1 Dec. 27, 2018

(30) Foreign Application Priority Data

Dec. 18, 2015 (DE) ..... 20 2015 106 931 U

(51) Int. Cl.
*B65D 1/40* (2006.01)
*B67D 3/00* (2006.01)
(Continued)

(52) U.S. Cl.
CPC ..... *B67D 1/001* (2013.01); *A47G 19/2205* (2013.01); *B67D 1/0003* (2013.01);
(Continued)

(58) Field of Classification Search
CPC ..... B67D 1/001; B67D 1/0082; B67D 1/06; B67D 1/1272; B67D 1/0894;
(Continued)

(56) References Cited

U.S. PATENT DOCUMENTS 2,529,794 A * 11/1950 Brown ..... A61J 9/04 215/11.5
3,292,808 A * 12/1966 Greene ..... A61J 9/04 215/11.5
(Continued)

FOREIGN PATENT DOCUMENTS

CN 101401696 A * 4/2009
CN 203855398 U * 10/2014
(Continued)

*Primary Examiner* — Marina A Tietjen
*Assistant Examiner* — Stephanie A Shrieves
(74) *Attorney, Agent, or Firm* — Andrew Wilford

(57) ABSTRACT

According to the invention, in order to create a container (1) for receiving beverages, in particular a drinks container or drinks cup, at least comprising a base (2) and a circumferential wall (3) projecting approximately perpendicularly from the base (2), which can be produced particularly inexpensively, can be filled within a minimum time and can be securely sealed after the filling, the wall (3) has openings (4) via which the container (1) can be filled with a beverage, wherein the openings (4) can be closed after the filling via a sealing means that is/can be applied from outside to the outer surface of the wall (3). The invention also relates to a device that can fill a container of this type with a corresponding beverage, such as beer or a soft drink, within a minimum time, said device being simple to operate, inexpensive and simple to produce and having a long service life.

22 Claims, 4 Drawing Sheets

(51) Int. Cl.

| | |
|---|---|
| ***B67D 7/44*** | (2010.01) |
| ***B67D 1/00*** | (2006.01) |
| ***B67D 1/06*** | (2006.01) |
| ***B67D 1/12*** | (2006.01) |
| ***A47G 19/22*** | (2006.01) |
| ***B67D 1/08*** | (2006.01) |
| *B65D 25/00* | (2006.01) |

(52) U.S. Cl.
CPC ..... *B67D 1/0082* (2013.01); *B67D 1/06* (2013.01); *B67D 1/0894* (2013.01); *B67D 1/1272* (2013.01); *B65D 1/40* (2013.01); *B65D 25/005* (2013.01); *B67D 2001/0094* (2013.01); *B67D 2001/0095* (2013.01)

(58) Field of Classification Search
CPC ..... B67D 3/0083; B67D 2001/0095; B67D 2001/0094; B67D 1/0003; B67D 7/44; A47G 19/2205; B65D 1/06; B65D 1/40; B65D 2205/025; B65D 25/005; B05B 11/00446; B05B 11/0005; A45F 2200/0583; A45F 3/18; A45F 3/20; A45F 3/16
USPC .... 141/113, 192, 198, 351, 360, 369; 215/2; 220/676, 703
See application file for complete search history.

(56) References Cited

U.S. PATENT DOCUMENTS

| | | | | |
|---|---|---|---|---|
| 8,151,838 | B2 * | 4/2012 | Seaborne | A47G 19/2205 141/350 |
| 8,899,281 | B2 * | 12/2014 | Russell | A47G 19/2205 141/113 |
| 8,997,803 | B2 * | 4/2015 | Fallon | B67D 1/0003 141/198 |
| 9,016,333 | B2 * | 4/2015 | Shaffer | B65D 1/04 141/113 |
| 9,974,412 | B2 * | 5/2018 | Kollep | A47J 31/4403 |
| 2008/0223478 | A1 * | 9/2008 | Hantsoo | B65D 1/265 141/2 |
| 2011/0121020 | A1 * | 5/2011 | Springer | A47G 19/2205 222/1 |
| 2011/0240170 | A1 | 10/2011 | Fallon | |

FOREIGN PATENT DOCUMENTS

| | | | |
|---|---|---|---|
| CN | 104352135 | A * | 2/2015 |
| JP | 5650779 | B2 * | 1/2015 |
| KR | 20130125634 | A * | 11/2013 |
| KR | 101362598 | B1 * | 2/2014 |

* cited by examiner

CONTAINER FOR RECEIVING BEVERAGES AND DEVICE FOR FILLING THE CONTAINER

CROSS REFERENCE TO RELATED APPLICATIONS

This application is the US-national stage of PCT application PCT/DE2016/100572 filed 12 Dec. 2016 and claiming the priority of German patent application 202015106931.6 itself filed 18 Dec. 2015.

FIELD OF THE INVENTION

The invention relates to a container for holding a beverage, particularly a drinking vessel or a drinking cup, comprising at least a bottom and a circumferential wall projecting approximately perpendicularly from the bottom.

In addition, the invention relates to an apparatus for filling such a container with beer or a soft drink with particular speed and ease.

BACKGROUND OF THE INVENTION

In particular, at large events with a high number of visitors, the need often arises to provide a very large number of freshly prepared beverages to the visitors to the event within an extremely short time. During a major sporting event, for example, several thousand beverages must be dispensed during a break, since a number of visitors totaling up to all of those attending the sporting event may wish to get a beverage during the break. Since the breaks at such events are often very limited in time, it is often not possible in practice to provide a great number of people with the appropriate beverages in a timely manner, since the filling of conventional containers, such as drinking cups, for example, with a freshly drawn beer or a freshly tapped soft drink often takes a long time. It is not therefore possible to provide a large amount of beverages in a timely manner with only a manageable number of taps.

As a result, many visitors to such major events often refrain from inquiring about and/or purchasing a corresponding beverage. Frequently, the visitors to such major events must stand in long lines, and it is not uncommon for the beverage to be given to the consumer only at the end of the break or after the break at a sporting event, for example. This, in turn, causes many consumers to refrain from consuming such a beverage the next time they visit such a sporting event.

In order to circumvent this problem, i.e. to provide a container for filling with a beverage such as beer or a soft drink by means of a corresponding apparatus within an extremely short time, a container is known in the prior art in which an opening is provided in the bottom that is surrounded by a metal ring integrated in the bottom through which the container can be filled through the bottom, and, after filling, is sealed by a magnetic body, particularly a circular magnetic plate, that is placed on the metal ring that is embedded in the bottom. Such a container can be filled within a relatively short time, thus enabling a large number of people to be provided with corresponding beverages within a relatively short time.

However, it is disadvantageous that such containers are extremely expensive both to produce and to subsequently dispose of, since the metal part that coacts with the magnetic plate must be elaborately incorporated into the appropriately shaped bottom of the container and separated again from the bottom at the time of disposal.

OBJECT OF THE INVENTION

In view of the abovementioned prior art, it is the object of the present invention to provide a container of the type described above that is especially inexpensive to produce, can be filled within an extremely short time, and then sealed securely after filling.

In addition, it is the object of the present invention to provide an apparatus that can fill such a container within an extremely short time with a corresponding beverage such as beer or a soft drink that is easy to use, inexpensive, easy to make and has a long service life.

SUMMARY OF THE INVENTION

In order to achieve the first part of its object, the invention proposes that the wall of the container have perforations through which the container can be filled with a beverage, with the perforations being sealable upon completion of the filling by a seal element that can be or is applied to the lateral surface of the wall from the outside.

By virtue of the fact that the wall of such a container has perforations through which the beverage can be introduced into the container, it is possible to merely provide commercially available and widely used standard containers such as drinking cups with additional perforations in the side wall and to fill them accordingly. By filling through the perforations in the wall, such a container can be filled with beer, for example, within approximately two seconds. This makes it possible to fill the container through the perforations that open laterally on the wall of the container at a beverage inflow rate of approximately 30 liters per minute.

After the container has been filled, the perforations are sealed by a suitable seal element.

In particular, preferably all of the perforations are at the same spacing from the bottom of the container and are distributed uniformly around the circumference of the wall.

The perforations are thus spaced around the wall of the container, and the perforations are all angularly equispaced from one another. This enables an especially uniform inflow of the beverage that is flowing through the perforations into the container. This also prevents excessive foaming.

What is more, especially preferably perforations of the wall are arranged or formed in a region of the wall that is near the bottom.

This enables the container to be filled from a region near the bottom toward the mouth of the container. This has proven to be particularly advantageous because, particularly when a foam-producing beverage such as beer is being filled, the container can thus be filled not only very quickly, but also in such a way as to avoid excessive and possibly time-delaying foaming as a result of the filling into the container.

The seal element is prepositioned on the outer surface of the wall of the container or can be prepositioned on the outer surface of the wall of the container.

Moreover, especially preferably the seal element consists of an elastic ring having at least one flat side that can be or is pushed onto the wall of the container and is displaceable along the wall, with the width of the ring being larger than the diameter of the perforations.

Such an elastic ring can be pushed up with particular ease with its flat side onto the wall of such a container and positioned on the wall at the level of the perforations so as to completely cover the perforations. This provides an inexpensive and simple means for sealing the perforations and thus preventing the beverage from flowing out through the perforations. The ring can also serve as an advertising medium, and advertising for the filled beverage or also any other advertising can be provided on its outer surface facing the user, which can be round or also flat.

The fact that the width of the ring is greater than the diameter of the perforations ensures that the perforations are completely covered and thus sealed off toward the outside. Outflow of liquid from the container through the perforations to the outside is effectively prevented with an appropriately placed elastic ring.

In particular, especially preferably the ring is prepositioned in a position on the container near the bottom of the container so as to engage around the wall and is displaceable along the wall for the purpose of sealing the perforations, with the distance of the perforations from the bottom being greater than the width of the ring, and with the ring being prepositioned near the perforations between the perforations and the bottom of the container.

As a result, all that needs to be done after the container is filled with a beverage is to displace the ring from its prepositioned place on the wall of the container into a position that completely conceals or covers the perforations of the container, thereby sealing them off toward the outside. By virtue of the fact that the ring is prepositioned near the bottom and the perforations are formed in a nearby region of the wall, only a slight displacement of the ring along the wall of the container is required, so that, within an extremely short time after the container is filled, for example, the ring need only be displaced a distance that is only slightly greater than the diameter of the perforations in order to completely seal the perforations.

This can be done within an extremely short amount of time. The corresponding containers can thus be premade with a ring that is already prepositioned as a seal element near the perforations of the wall, so that it only needs to be filled accordingly and then the ring moved into the sealing position.

The ring, which also serves as an advertising medium, for example, can then be removed from the container in a quick and easy manner by the consumer after consumption of the beverage, whereupon it becomes the property of the consumer. The appropriately designed ring can also serve as a memento of the event for the consumer or as a lasting advertising medium.

Moreover, especially preferably the ring is made of a food-grade synthetic such as silicone or rubber.

The use of a food-grade synthetic such as silicone or rubber ensures that the beverage is not adversely affected by the ring in terms of its taste or otherwise.

Finally, especially preferably a ridge or shoulder is formed on the outer surface of the wall that forms a travel-limiting stop for the ring.

Such a ridge or shoulder on the outer surface of the wall and forming a travel-limiting stop for the ring ensures that, when the ring is being moved into the sealing position, it is not displaced beyond the target position. The travel-limiting stop is positioned so as to be above the perforations in the upward direction of displacement in a region adjacent to the perforations of the container, so that the ring, which is prepositioned near the bottom, for example, is moved toward the perforations after the container is filled until it abuts against this shoulder, which forms a travel-limiting stop, and cannot be displaced any further. Upon coming into contact with the travel-limiting stop, the ring is already located in the sealing position, and outflow of liquid from the container is reliably prevented.

Such a container can be manufactured in a simple and especially economical manner. It is possible, for example, to provide cups that are commercially available with appropriate perforations in their walls in order to enable them to be filled through the perforations in a particularly quick manner. Due to the fact that such cups are already very widely available on the market, the machines that are used to produce such cups only have to be altered in such a way as to enable the appropriate perforations to be cut into these containers. The production costs of such containers, like drinking cups, in particular, are thus extremely low. The containers can be used both as reusable containers and as disposable containers and/or be manufactured accordingly.

The prepositioning of the rings acting as seal elements on a region of the wall near the bottom of the container can be done either by hand or mechanically by a suitable machine.

Particularly in the case of reusable containers, after the container is cleaned, the corresponding ring serving as an advertising medium can be fitted onto the region of the wall near the bottom of the container.

With such an apparatus, a container of the above-described type, particularly a drinking cup, can be placed quickly and easily by hand into a seat of the apparatus. After the container is placed into the seat in a first position, which represents a filling position, the beverage flows into the container through the perforations of the container. The apparatus is connected to at least one regulatable supply line for at least one beverage to be filled into the container. For example, the supply line can be connected indirectly by a duct formed in the apparatus that leads to the level of the perforations of the container in the filling position, in which case the beverage that is supplied via the supply line is already pressurized, particularly with carbonic acid, and a control device that enables a predetermined amount of liquid to flow into the container, such as a valve or flow meter, for example, can be used to determine a predetermined amount with which to fill the container according to its size. After filling, the container can be moved within the seat into a second position, which represents a sealing position.

This is done by simply exerting pressure on the cup in the vertical direction, i.e. into a position that projects downward beyond the filling position into the apparatus or the seat of the apparatus. Upon further movement of the container with the ring arranged as a seal element near the perforations between perforations and bottom of the container, the ring abuts against parts of the apparatus, so that the container is moved relative to the ring until the ring is in the sealing position, i.e. until it is located on the wall of the container in a position that completely covers the perforations of the container.

The filled container can then be removed from the apparatus and handed over to a consumer.

With such an apparatus according to the invention, a container such as that described above can be filled with a desired beverage, particularly with beer, in an especially easy and especially quick manner. This makes it possible to fill a large number of containers with the respective desired beverages within an extremely short amount of time in order to provide a large number of people with corresponding beverages during a break at a major event, for example.

Such an apparatus can also be operated by a layperson in the easiest of manners, since that the user need only fit the required drinking cup constituting the container into a first position that is approximately upright in the apparatus, and then, after the container has been filled, move the container further in the same direction in order to seal the perforations of the container. The container can then be removed and handed out accordingly.

In an especially preferred embodiment of the invention, the housing consists of a lower part and an upper part. The lower part has a cylindrical recess that opens toward the upper part. The upper part is formed as a top cover with a circular hole that can be fastened to the lower part. In the assembled position, the circular hole covers the mouth of the cylindrical recess at least partially. A displaceable sleeve is arranged within the cylindrical recess. In a non-use position, the sleeve rests against the top cover. The circular hole of the top cover and the space enclosed by the sleeve together form a seat for the bottom and at least the portion of the wall of the container that has the perforations. A pressure piece that can be displaced both together with the sleeve and relative to the sleeve against the force of a spring is provided within the sleeve. In a first set position of the container in the seat, which constitutes a filling position, the sleeve is displaced together with the pressure piece in a direction away from the top cover, and in a second position, which constitutes the sealing position, only the pressure piece is moved further in the same direction. The sleeve abuts against a travel-limiting stop, and the pressure piece is further displaced relative to the sleeve. In the filling position, a gap is formed between the top cover and sleeve that opens on the inside of the housing at the level of the perforations of the positioned container and is connected on the outside indirectly to at least one supply line for at least one beverage via a feed duct that is formed in the lower part.

Such an apparatus according to the invention enables even an inexperienced user to fill a suitable container with a beverage in an especially quick and easy manner. To fill the container, the user only has to place the container into the apparatus in a first filling position. This is done by moving the container vertically downward into the seat of the apparatus and requires the exertion of only a slight amount of downward pressure on the container in the vertical direction. The filling occurs as a result of the bottom of the container moving the sleeve away from the top cover, thereby oorming a feed opening between the sleeve and the top cover through which the beverage can flow toward the perforations of the container and then through them into the container. After successful filling of the container, the user must again only exert a further small amount of downward pressure on the container in an approximately vertical direction in order to move the container relative to the secured ring into a position in which the ring seals the perforations of the container. The displacement path is limited both by the apparatus itself, since, for further displacement, only the pressure piece is moved toward the bottom of the lower part against the force of a spring. The sleeve remains in the filling position, and only the pressure piece is moved further along. This ensures that the ring that constitutes the seal element remains in this position and only the container is further displaced downward relative to the ring in the vertical direction toward the lower part until the ring is in the sealing position in which it completely covers the perforations. The container can then be removed from the apparatus and handed over to the consumer, for example.

In order to enable particularly quick disassembly of the essential parts of the apparatus, especially preferably a respective thread can be formed on the lower part with cylindrical recess and on the top cover so that the parts can be screwed together.

This makes it possible to separate the lower part from the upper part with particular speed and ease, which may for necessary for cleaning, for example.

In order to clean the apparatus, the top cover can be unscrewed from the lower part, after which corresponding parts such as the sleeve, for example, can be removed from the apparatus in order to be cleaned individually. Quick and easy access is thus also provided for the purpose of cleaning the remaining parts that are not detached from the lower part.

This also makes it possible to replace the upper part, which is formed by a top cover, and the sleeve with parts having different dimensions. As a result, the apparatus can be used to fill containers of different sizes and, as desired, of different beverage-holding capacities.

The apparatus can thus be used to fill containers of different sizes by quickly and easily switching out the top cover and the sleeve.

Furthermore, especially preferably the spring can be provided between the lower part and the pressure piece.

The spring, which also returns both the pressure piece and the sleeve to the non-use position, is arranged approximately centrally under the pressure piece between the pressure piece and the lower part, thus enabling maximally uniform pressure to be exerted on the parts to be moved by the spring.

Moreover, especially preferably each supply line can be connected to a quantity control unit and/or time control unit by means of which the flow rate of the respective beverage through the respective supply line is adjustable or measurable and adjustable.

In order to adapt the amount of beverage to be dispensed by the apparatus to the container, such a quantity control unit and/or time control unit can already be provided outside the apparatus, for example in or on each supply line. As a result, it is possible to fill a container having any desired volume in a quick and easy manner with exactly the amount that is predetermined by the volume of the container. For example, a user of the apparatus can set the volume to be dispensed once, and then this is automatically delivered to each container that is put in place.

What is more, a provision can be especially preferably made that each supply line can be controlled with or with feedback by a switchable valve that can be or is switched by a starter that is in the apparatus.

Such a starter can be in the displacement path of the sleeve section, for example, meaning that it is switched to the filling position upon displacement of the sleeve, thereby starting the feed of the beverage through the supply line and the feed duct that is formed on the apparatus. After delivery of the predetermined amount, the supply is automatically interrupted in order to prevent the container from overflowing. In addition, the starter can be connected to additional acoustic or optical signaling means that signal to the user that the container is no longer being filled and can now be displaced further from the filling position into the sealing position.

This can be communicated to the user both by optical and by acoustic signaling.

In particular, especially preferably the starter can be formed as a switching contact that actuates an electrical switch that is switched by displacement of the sleeve into the filling position.

Especially preferably an optical signaling means, particularly an LED, can be arranged in the lower part or in the pressure piece that shines through the bottom of a positioned container.

Such an optical signaling means, which preferably consists of an LED, can signal to the user of the apparatus in a quick and simple manner that the container has been filled and can be further displaced into the sealing position. By virtue of a light source that shines through the bottom of a positioned container, the user can quickly and easily recognize that the container has been filled and must now be moved into the sealing position even in an environment with loud noises.

In a preferred embodiment, the LED is surrounded by the spring that is arranged between the pressure piece and the lower part and shines through the bottom of the container.

Moreover, especially preferably the circular hole of the top cover can open into a funnel shape toward the free end, in which case a circumferential seal is arranged on an inner circumferential surface of the region surrounding the seat near the end of the top cover facing toward the sleeve that seals the positioned container relative to the inner circumferential surface of the top cover.

The funnel-shaped opening enables the container to be filled to be placed in an especially quick and easy and also solidly positioned manner into the seat of the apparatus.

What is more, this ensures the circumferential seal between the parts that prevents liquids from unwantedly flowing out.

A provision can also be especially made that at least one duct, preferably a plurality of ducts, are arranged between pressure piece and inner circumferential surface of the sleeve and/or between the sleeve and the cylindrical recess, which ducts are connected to a main drain duct that emerges on a housing outer side and is or can be connected there to a drainage line or catch basin.

The arrangement of such ducts enables liquid collecting within the seat of the apparatus to be discharged from the apparatus with particular ease. The ducts also facilitate the cleaning of the apparatus after the end of use by flushing the apparatus with water and/or cleaning agent, with it being possible for the water and/or cleaning agent to drain out through the ducts. Discharging of accumulating liquids as well as cleaning of the apparatus are thus made possible.

Furthermore, especially preferably a travel-limiting stop consisting of a projection can be provided on the inner circumferential surface of the sleeve.

The projection is arranged such that the ring surrounding the bottom of the wall of the container abuts against the projection in the filling position. That is, the ring cannot be moved further upon further displacement of the container into the seat of the apparatus, since it is bearing against this one projection that constitutes a travel-limiting stop. Upon further displacement of the container into the sealing position, the ring thus remains in an unchanged position relative to the apparatus, and only the container is moved relative to the ring into a position in which the ring completely covers, and thus seals, the perforations of the wall of the container.

Moreover, especially preferably the supply duct for supplying beverages can be connected to two or more, particularly four, beverage supply lines.

This makes it possible to fill various beverages that cater to consumers' desires into a container using only one apparatus.

Furthermore, especially preferably seal rings can be respectively arranged between the top cover and the lower part and between the sleeve and the lower part that provide a fluid-tight seal between the parts.

A provision can be especially preferably made that each of the seals consists of an O-ring made of rubber.

Through the arrangement of such O-rings as seals, unwanted flow of liquids between the parts is largely prevented. This ensures, for example, that beverage residues from the previous filling of a vessel do not remain between these parts and, upon later filling, get into the container again.

In particular, a provision can be especially preferably made that the apparatus is or can be integrated into a counter worktop.

Such an apparatus according to the invention can be formed as an integral part of a counter worktop. In that case, the top cover can be flush with the screen plate of a counter work surface, for example, and the lower part can be flush with the tray forming a drip tray of a counter worktop, for example.

Finally, especially preferably the apparatus can have a power storage means such as a rechargeable battery or standard battery for powering the signaling means and/or the starter that enables standalone operation of the apparatus.

Such a standalone operating apparatus with a power storage means for powering the signaling means and/or the starter can make it possible to use such an apparatus in almost any location.

A supply line with an already pressurized beverage need only be connected to the apparatus, and the apparatus can then be operated without further assistance or without additional power sources or the like.

BRIEF DESCRIPTION OF THE DRAWING

An embodiment of the invention is illustrated in the drawings and described in further detail in the following.

SPECIFIC DESCRIPTION OF THE INVENTION

Figure 2:
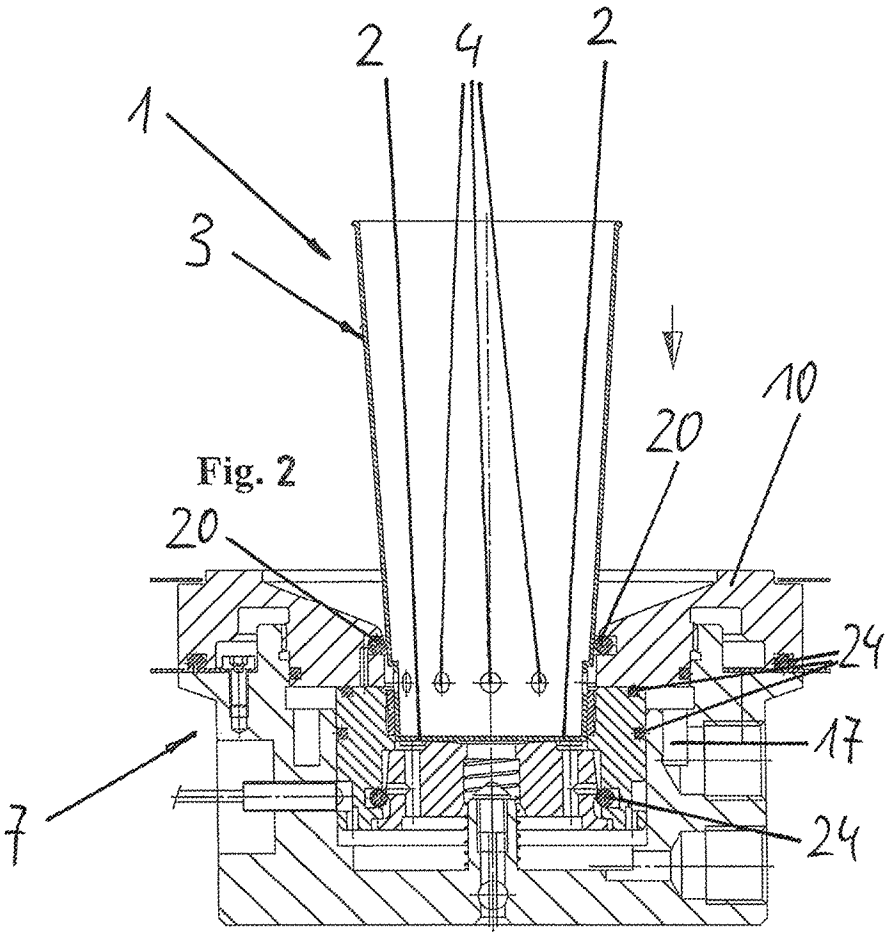
FIG. 2 is the same, but with the drinking cup placed in a non-use position in the seat of the apparatus.

For one, the figures show a container 1 for holding a beverage. In this embodiment, the container 1 is a drinking cup. The drinking cup has at least one bottom 2 and one side wall 3 that projects approximately perpendicularly upward from the bottom 2.

According to the invention, the wall 3 of the container 1 has perforations 4. The container 1 can be filled with a beverage through the perforations 4. Once filling has been completed, the perforations 4 can be sealed by a seal element that can be applied externally to the lateral surface of the wall 3. Such a container 1 can be filled in an especially quick and easy manner by supplying pressurized beverage through the perforations 4 in the wall 3. In this embodiment, all of the perforations 4 are at the same spacing from the bottom 2 of the container 1 and are distributed angularly uniformly around the circumference of the wall 3. The perforations 4 of the wall 3 are arranged in a region of the wall 3 that is near the bottom 2.

In this embodiment, the seal element is an elastic ring 5 that in this embodiment has two flat sides. The ring 5 presses with its flat side against the wall 3 of the container 1. The width of the ring 5 is greater than the diameter of the perforations 4, so that the ring 5 completely covers the perforations 4 in a position in which it is pushed onto the perforations 4. As a result, liquid is prevented from flowing out of the container 1 after the ring 5 has been pushed up into the sealing position.

In this embodiment, the ring 5 is prepositioned in a position that is near the bottom 2 of the container 1 so as to engage around the wall 3. In order to seal the perforations 4, the ring 5 can be displaced upward along the wall 3. In order to prevent partial covering of the perforations 4 in this prepositioned orientation, the distance between the perforations 4 and the bottom 2 is greater than the width of the ring 5. The ring 5 is prepositioned near the perforations 4 between these perforations 4 and the bottom 2 of the container 1 and can be moved quickly and easily from this prepositioned orientation toward the perforations 4, with the perforations 4 being completely covered in the sealing position and thus completely sealed.

The ring 5 is made of a food-grade synthetic, here silicone.

Alternatively, the ring 5 could also be made of another food-grade synthetic, such as rubber.

In order to prevent displacement of the ring 5 beyond the sealing position, i.e. beyond the perforations 4, a shoulder 6 is formed on the outer surface of the wall 3 in this embodiment. The shoulder 6 thus forms a travel-limiting stop for the ring 5.

The ring 5 forming the seal element must be flat only on its side facing the wall 3 of the container 1, so that it covers the perforations 4 and rests flat against the wall 3. The radially outwardly directed surface may differ from a flat surface and thus serve as an advertising medium. This can be achieved by a contoured surface that deviates from the flat surface as well as by printing.

In addition, an apparatus 7 for the especially quick filling of such a container 1 is shown in the figures. The apparatus 7 has a housing with a lower part 8 and an upper part. The lower part 8 has a cylindrical recess 9 that opens upward toward the upper part. The upper part is formed as a top cover 10 with a circular hole 11 that can be fastened to the lower part 8. A thread 18, 19 that holds together the parts (8 and 10) is formed on the lower part 8 with cylindrical recess 9 and on the top cover 10.

Figure 1:
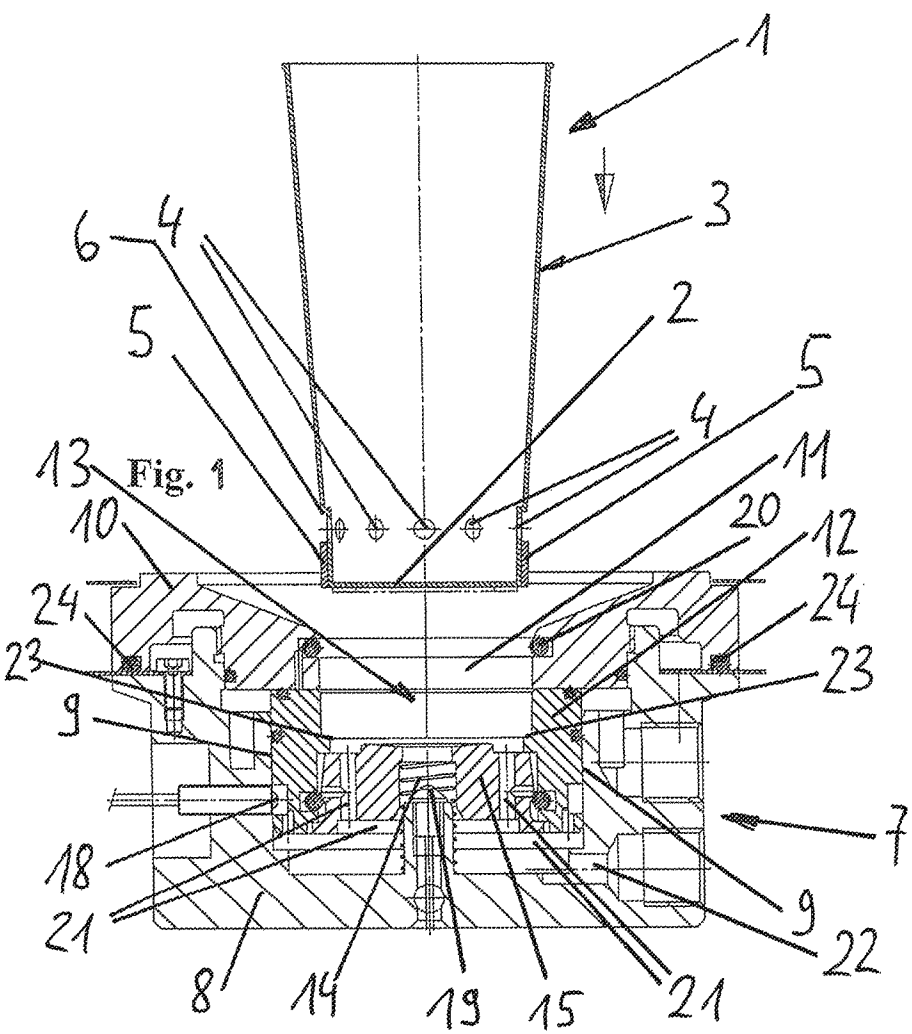
FIG. 1 is a sectional side view both of an apparatus according to the invention and of a drinking cup according to the invention in a prepositioned orientation.
Figure 4:
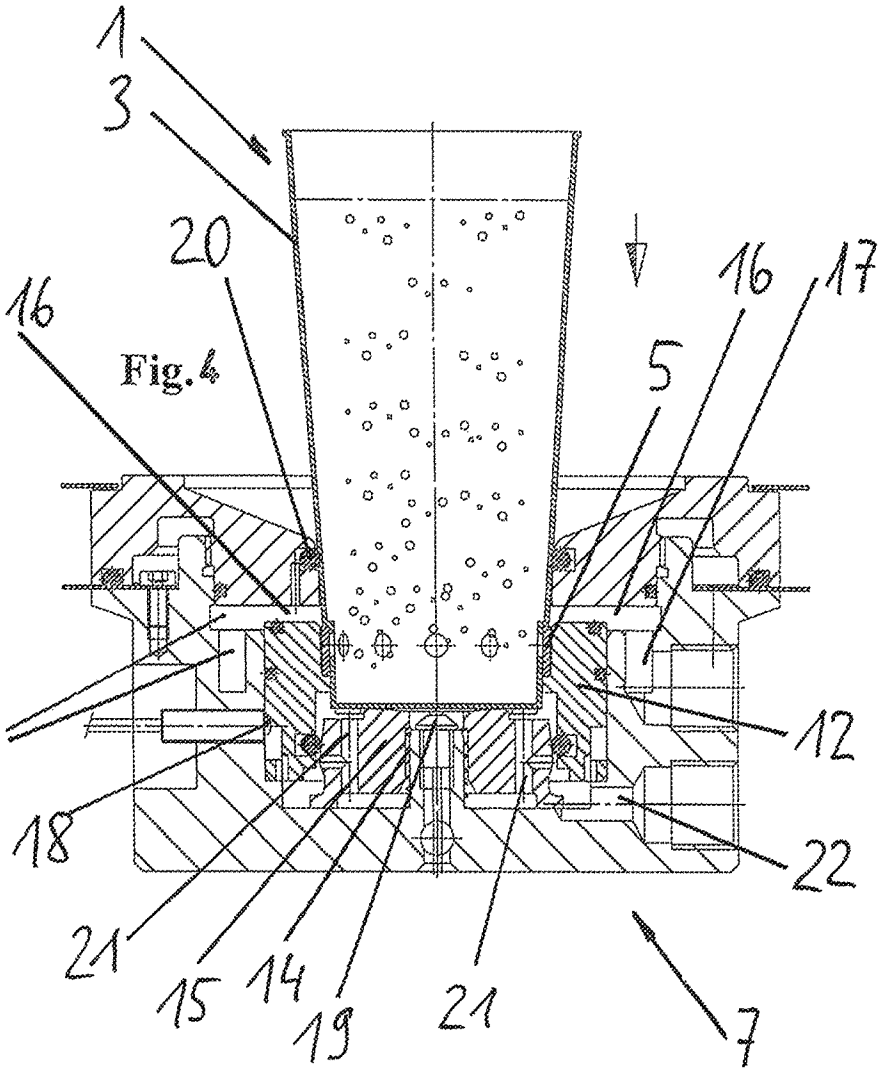
FIG. 4 is the same in the sealing position.
Figure 3:
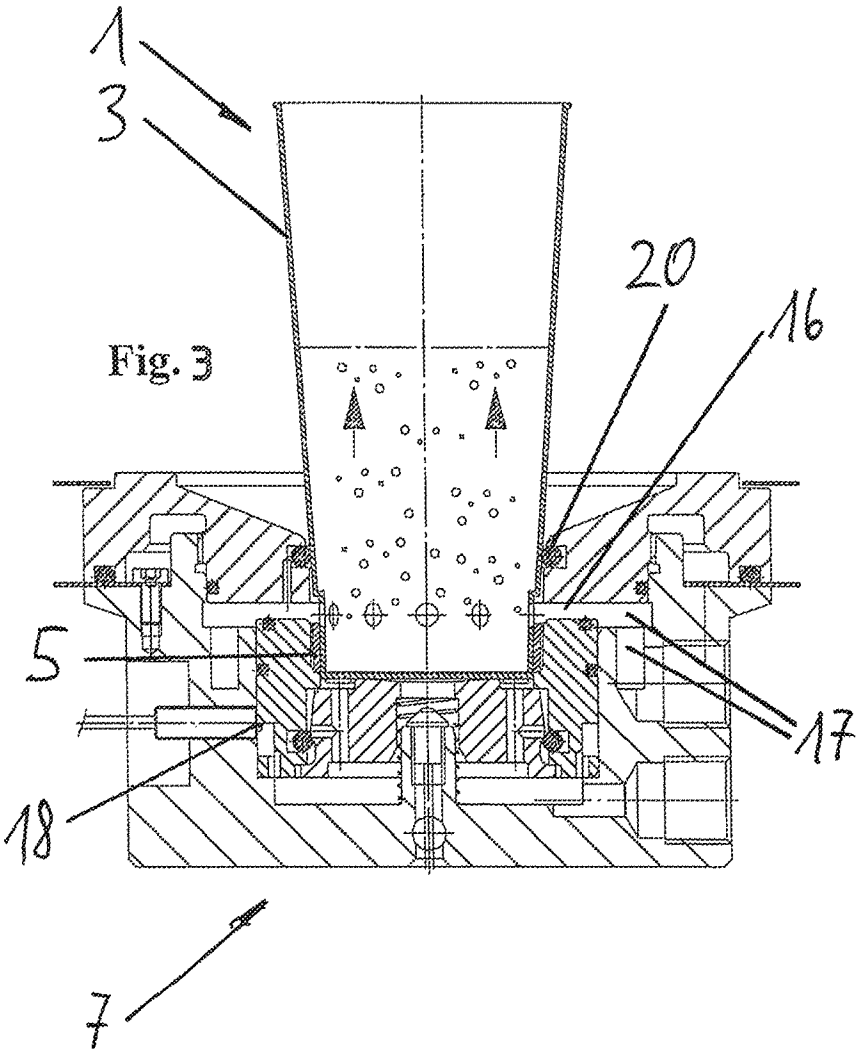
FIG. 3 is the same in the filling position.
Figure 6:
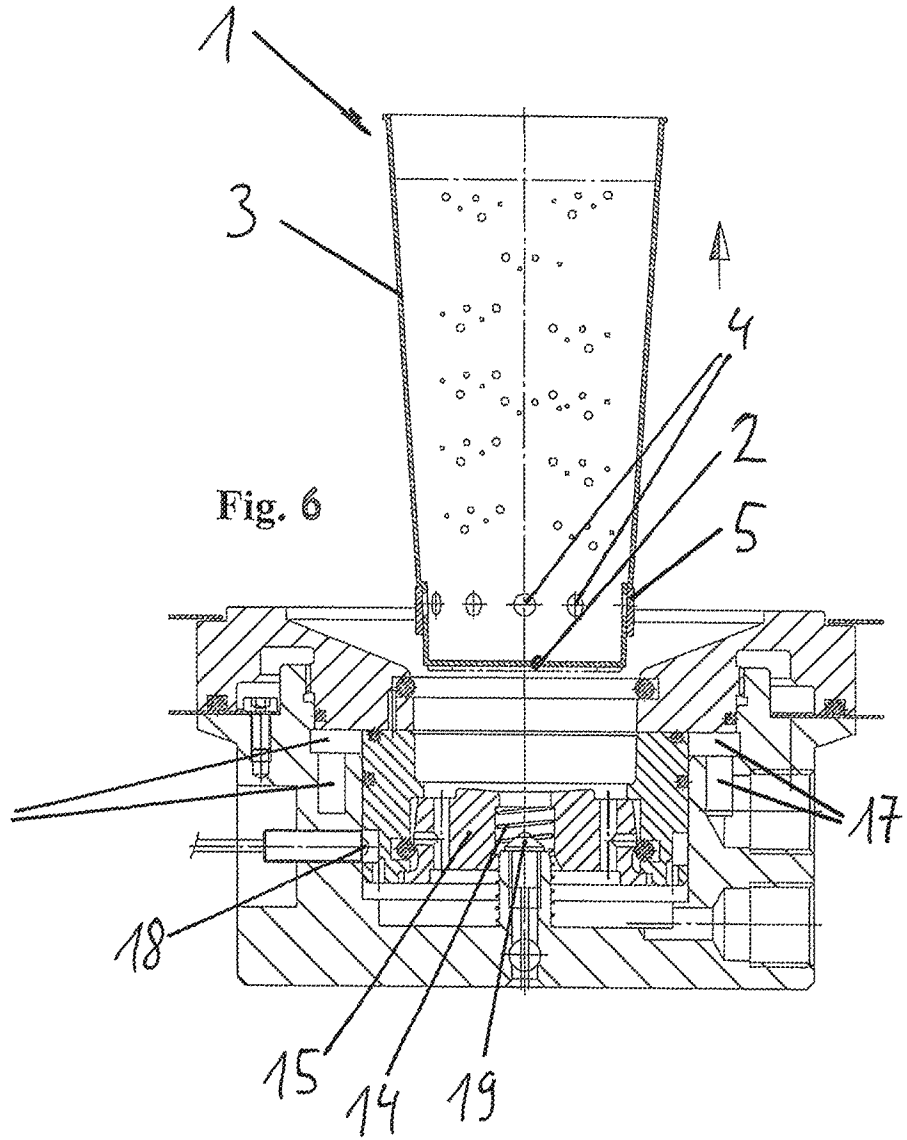
FIG. 6 is the same with a filled, sealed, and removed drinking cup.
Figure 5:
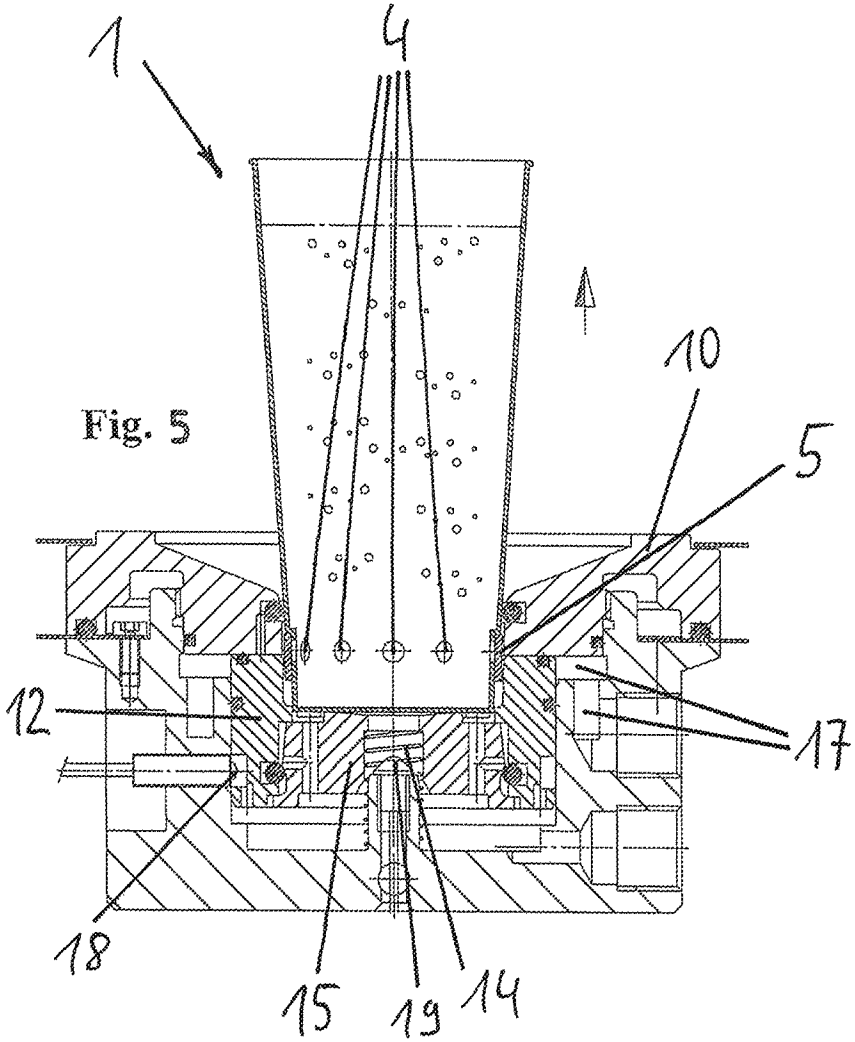
FIG. 5 is the same with a schematic representation of the direction of removal.
Figure 7:
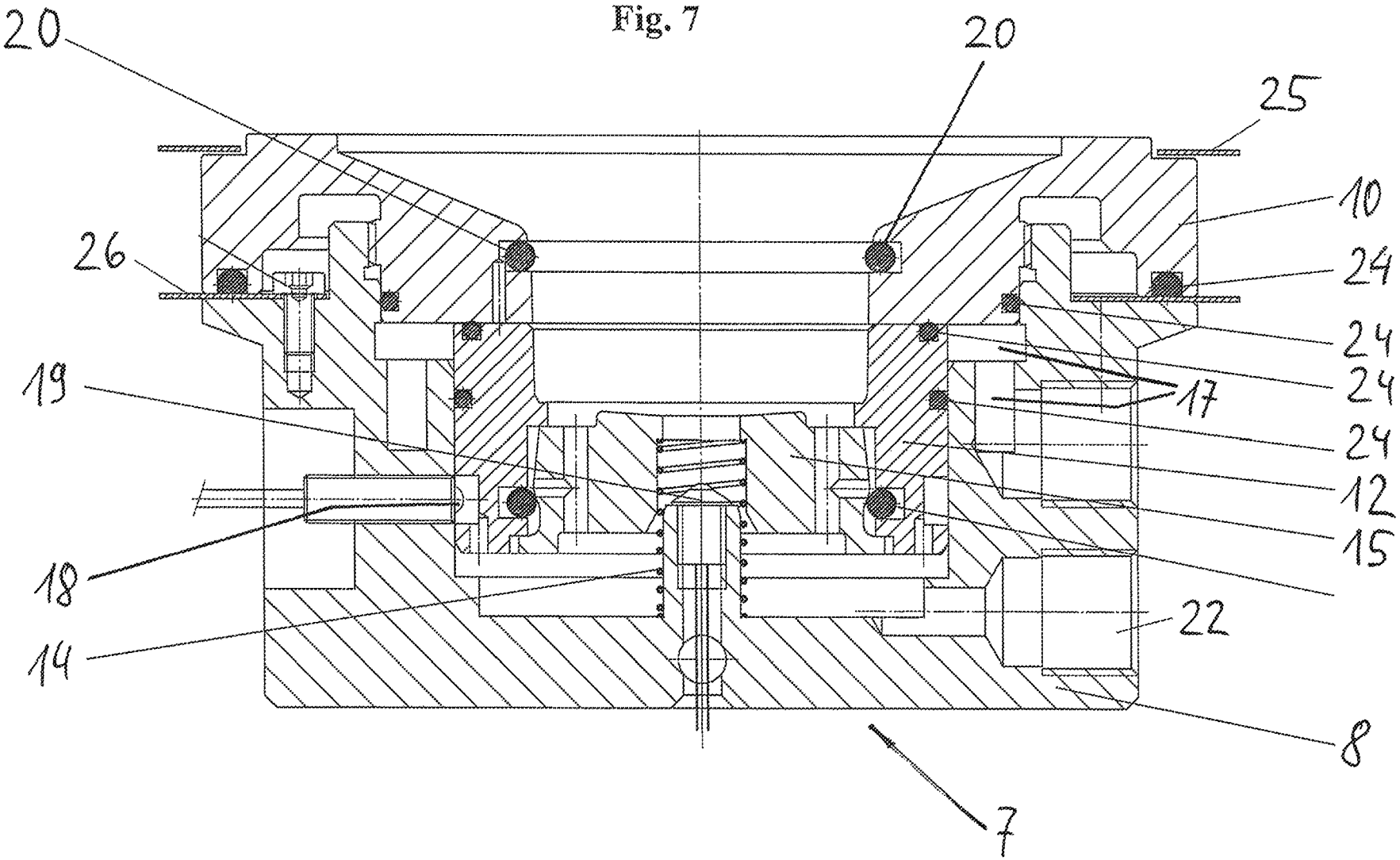
FIG. 7 is a sectional side view of an apparatus according to the invention.

In the assembled position, the circular hole 11 covers the mouth of the cylindrical recess 9 at least partially, and a sleeve 12 is slidable within the cylindrical recess 9. The upper end of the sleeve 12 facing the top cover 10 is positioned so as to rest against the top cover 10 in a non-use position (FIGS. 1, 2, 5, 6). The circular hole 11 of the top cover 10 and the space enclosed by the sleeve 12 together form a seat 13. The bottom 2 and at least the portion of the wall 3 of the container 1 that has the perforations 4 can be inserted into the seat 13. A pressure piece 15 that can be displaced both together with the sleeve 12 and relative to the sleeve 12 is arranged within the sleeve 12. Upon being displaced into a first position, which constitutes the filling position, the sleeve 12 and the pressure piece 15 are displaced together against the force of a spring 14. Subsequently, upon further displacement into the sealing position, only a further movement of the pressure piece 15 occurs against the force of the spring 14. During displacement from the filling position into the sealing position, the sleeve 12 thus remains in an unchanged position relative to the filling position. In order to ensure this retention of the sleeve 12 in the filling position, a travel-limiting stop is formed on the apparatus against which the sleeve 12 abuts in the filling position, which prevents further movement of the sleeve 12. Once the filling position is reached, a gap 16 is formed between top cover 10 and sleeve 12. The gap 16 opens out on the inside of the housing at the level of the perforations 4 of the positioned container 1 and thus enables a beverage to flow through the perforations 4 of the positioned container 1. In this embodiment, the feed duct 17 is connected to a supply line for a pressurized beverage.

A pressurized beverage can thus be filled with particular speed and ease after the container 1 is fitted into the apparatus 7 and pressure is applied to the container 1 in an approximately vertically downward direction relative to the apparatus 7.

The spring 14 is between the lower part 8 and the pressure piece 15, ensuring return to the non-use position by the spring 14 after removal of the container 1 from the apparatus 7.

Although this cannot be seen from the figures, the supply line for beverages can be connected to a quantity control unit or time control unit or to a combination of quantity and time control. With such units, the flow rate of the beverage or the flow time and thus the quantity conveyed through the respective supply line is adjustable and optionally measurable and then adjustable. This makes it possible to fill containers 1 of different sizes with a suitable desired amount.

For this purpose, a one-time adaptation to the size of the container to be filled 1 is performed, and then this amount is stored by the quantity control or timing unit, whereupon no further adaptation is required for further filling. This only needs to be readjusted when a container 1 having a different capacity is to be used.

In this embodiment, a starter that is formed as a switching contact 18 is also arranged on the apparatus 7. The switching contact 18 actuates an electrical switch that is switched by displacement of the sleeve 12 into the filling position and forwards this to appropriate signaling means.

In this embodiment, the signaling means is formed as an LED 19 that shines through the pressure piece 15 at the bottom 2 of the positioned container 1. This LED 19 can signal to the user of the apparatus 7 that the container 1 has been filled. In this embodiment, the switching contact 18 of the starter sends a control signal to the LED 19. During the filling process, the LED 19 thus lights up and indicates this to the user. Once the filling of the container 1 has been completed, the LED 19 goes out, thus signaling to the user that no further filling is occurring. Now the user can move the container 1 further downward into the seat 13 in an approximately vertical direction relative to the apparatus 7, so that the seal that is formed as a ring 5 and arranged near the bottom 2 of the container 1 is displaced relative to the container 1 into a sealing position in which the perforations 4 are completely covered. Once the filling position is reached, the ring 5 abuts against a projection 23 that is formed on an inner circumferential surface on the sleeve 12. Upon further displacement of the container 1 into the sealing position, the ring remains in this position, and the container 1 is moved relative to the ring 5 into a position in which the ring 5 completely covers and seals the perforations 4 of the wall 3 of the container 1.

The filled and sealed container 1 can then be removed by the user from the apparatus 7 and handed to the consumer.

In this embodiment, a feed duct 17 is formed for the purpose of supplying beverages. This can be connected outside the apparatus 7 to one or more beverage supply lines, thus enabling a choice to be made between different beverages.

Alternatively, and not shown in the figures, a plurality of feed ducts 17 can be formed on an apparatus 7, each of which is or can be connected to a beverage supply line.

In this way, namely by selecting the appropriate supply line, a consumer can be provided quickly and easily with a desired beverage.

As can be seen from the figures, ducts 21 are formed between pressure piece 15 and inner circumferential surface of the sleeve 12 and between sleeve 12 and cylindrical recess 9 that are connected to a main drain duct 22. The main drain duct 22 emerges on a housing outer side and is or can be connected there to a drainage line or catch basin. This enables extra beverage to be drained away in an especially simple and hygienic manner.

In addition, this simplifies cleaning after successful use of the apparatus 7.

Seals in the form of O-rings 24 made of rubber are arranged between the top cover 10 and the lower part 8 and between the sleeve 12 and the lower part 8 that provide a fluid-tight seal between the parts.

This embodiment shown in the figures shows an apparatus 7 that can be integrated into a counter worktop. In this case, the top cover 10 can be flush with a drainboard 25 (screen plate) of a counter work surface, for example, and the lower part 8 can be attached to a recess of the tray 26 (drip tray).

Alternatively, and not shown in the figures, such an apparatus 7 can also have power storage such as a rechargeable battery or a standard battery that is used to power the signaling means and/or the starter. This makes standalone operation of such an apparatus possible. To operate the apparatus 7, only a supply line with an already pressurized beverage needs to be connected to the apparatus 7.

In an additional embodiment that is not shown in the figures, a plurality of such apparatuses can be provided in an arrangement next to one another so as to enable a beverage to be filled by each of a user's hands.

The arrangement of four or more than four adjacent apparatuses 7 is also possible.

The invention is not limited to this embodiment, but rather can be varied in many respects within the framework of the disclosure.

All of the individual and combined features disclosed in the description and/or drawing are regarded as being essential to the invention.

The invention claimed is:

1. A container for holding a beverage, the container comprising:

a bottom, a wall projecting upward from the bottom and formed with perforations through which the container can be filled with the beverage, all of the perforations being at the same spacing from the bottom of the container and distributed uniformly around a circumference of the wall, and a seal element for sealing the perforations upon completion of the filling, the seal element being applicable to an outer surface of the wall from the outside.

2. The container defined in claim 1, wherein the perforations of the wall are arranged or formed in a region of the wall near the bottom.

3. The container defined in claim 1, wherein the seal element is prepositioned on the outer surface of the wall of the container or can be prepositioned on the outer surface of the wall of the container.

4. A container for holding a beverage, the container comprising:

a bottom, a wall projecting approximately upward from the bottom and formed with perforations through which the container can be filled with the beverage, and an elastic ring for sealing the perforations upon completion of the filling, the elastic ring being applicable to an outer surface of the wall from the outside and having a flat side that can be or is pushed onto the wall of the container and is displaceable along the wall, the width of the ring being larger than a diameter of the perforations.

5. The container defined in claim 4, wherein the ring is prepositioned on the container near the bottom of the container so as to engage around the wall and is displaceable along the wall for sealing the perforations, a spacing of the perforations from the bottom being greater than the width of the ring, the ring being prepositioned near the perforations between the perforations and the bottom of the container.

6. The container defined in claim 4, wherein the ring is made of a food-grade silicone or rubber.

7. The container defined claim 4, further comprising:

a ridge or shoulder formed on the outer surface of the wall that forms a travel-limiting stop for the ring.

8. An apparatus for filling a container having:

a bottom, a wall projecting approximately upward from the bottom and formed with perforations through which the container can be filled with a beverage, and a seal element for sealing the perforations upon completion of the filling, the seal element being applicable to an outer surface of the wall from the outside, the apparatus comprising:

a housing having a seat into which the bottom and at least a portion of the wall of the container that has the perforations can be inserted in an approximately vertical direction and sealed off against the outside environment, the housing having:

a lower part, an upper part, the lower part having a cylindrical recess that opens toward the upper part, and the upper part being formed as a top cover with a circular hole attachable to the lower part, the circular hole partially covering a mouth of the cylindrical recess in an assembled position, a sleeve slidable in the cylindrical recess and having an end facing toward the top cover that abuts against the top cover in a non-use position, the circular hole of the top cover and a space enclosed by the sleeve together forming a seat for the bottom and at least a portion of the wall of the container having the perforations, and a pressure piece displaceable both together with the sleeve and relative to the sleeve against the force of a spring in the sleeve in a first set filling position of the container in the seat, the sleeve being displaced together with the pressure piece in a direction away from the top cover, and in a second sealing position only the pressure piece being moved further in the same direction, the sleeve abutting against a travel-limiting stop and the pressure piece being displaced relative to the sleeve in the filling position; and a regulatable supply line for a beverage to be filled into the container, the supply line being connected at one end directly or indirectly to means that fill the beverage that is supplied via the supply line through the perforations into the container, the means being arranged in a first filling position of the container that is inserted into the seat at the level of the perforations of the container and enclosing the perforations, the container being displaceable in the seat into a second sealing position in which the container is displaced relative to the seal element into a position in which the perforations of the container are sealed by the seal element, a gap formed between the top cover and sleeve opening inside the housing at a level of the perforations of the positioned container and being connected outside the container indirectly to the supply line via a feed duct formed in the lower part.

9. The apparatus defined in claim 8, further comprising: respective threads that connect together the upper and lower parts.

10. The apparatus defined in claim 8, wherein the spring is between the lower part and the pressure piece.

11. The apparatus defined in claim 8, wherein the supply line is connected to a quantity control unit or time control unit for adjusting or measuring a flow rate of the respective beverage through the supply line.

12. The apparatus defined in claim 8, wherein the supply line can be controlled and regulated by a switchable valve that can be or is switched by a starter that is arranged in the apparatus.

13. The apparatus defined in claim 12, wherein the starter is formed as a switching contact that actuates an electrical switch that is switched through displacement of the sleeve into the filling position.

14. The apparatus defined in claim 12, further comprising: power-storage means for powering the signaling means and/or the starter that makes standalone operation possible.

15. The apparatus defined in claim 8, further comprising: an optical signaling means in the lower part or in the pressure piece that shines through the bottom of the positioned container.

16. The apparatus defined in claim 8, wherein the circular hole of the top cover opens into a funnel shape toward the free end, the apparatus further comprising:

a circumferential seal on an inner surface of the region surrounding the seat near the end of the top cover facing toward the sleeve that seals the positioned container relative to the inner surface of the top cover.

17. The apparatus defined in claim 8, further comprising: a duct between the pressure piece and the inner surface of the sleeve and/or between the sleeve and the cylindrical recess, the ducts being connected to a main drain duct that emerges on a housing outer side and connectable there to a drainage line or catch basin.

18. The apparatus defined in claim 8, further comprising: a travel-limiting stop consisting of a projection on the inner surface of the sleeve.

19. The apparatus defined in claim 8, wherein the supply duct for supplying beverages is or can be connected to two or more beverage supply lines.

20. The apparatus defined in claim 8, further comprising: seals between the top cover and the lower part and between the sleeve and the lower part that provide a fluid-tight seal between the upper and lower parts.

21. The apparatus defined in claim 20, wherein the elastic ring is an O-ring made of rubber.

22. The apparatus claim 8, wherein the apparatus is or can be integrated into a counter worktop.

* * * * *